US007414583B2

(12) United States Patent
Choi et al.

(10) Patent No.: US 7,414,583 B2
(45) Date of Patent: Aug. 19, 2008

(54) PIFA, RFID TAG USING THE SAME AND ANTENNA IMPEDANCE ADJUSTING METHOD THEREOF

(75) Inventors: Won-Kyu Choi, Gyeonggi-do (KR); Nak-Seon Seong, Daejon (KR); Cheol-Sig Pyo, Daegu (KR); Jong-Suk Chae, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 11/297,517

(22) Filed: Dec. 7, 2005

(65) Prior Publication Data

US 2007/0046543 A1 Mar. 1, 2007

(30) Foreign Application Priority Data

Dec. 8, 2004 (KR) ..... 10-2004-0103087
Jun. 9, 2005 (KR) ..... 10-2005-0049266

(51) Int. Cl.
*H01Q 1/38* (2006.01)
*H01Q 1/24* (2006.01)

(52) U.S. Cl. ..... 343/700 MS; 343/895; 343/846; 343/702

(58) Field of Classification Search ..... 343/770, 343/767, 846, 848
See application file for complete search history.

(56) References Cited

U.S. PATENT DOCUMENTS 6,369,761 B1 * 4/2002 Thiam et al. ..... 343/700 MS
6,388,626 B1 * 5/2002 Gamalielsson et al. ..... 343/702
6,573,869 B2 6/2003 Moore
6,683,576 B2 * 1/2004 Achim ..... 343/702
6,714,162 B1 * 3/2004 Kadambi et al. ..... 343/700 MS
6,741,214 B1 * 5/2004 Kadambi et al. ..... 343/700 MS
6,795,026 B2 * 9/2004 Chiu et al. ..... 343/702
6,819,287 B2 * 11/2004 Sullivan et al. ..... 343/700 MS (Continued)

FOREIGN PATENT DOCUMENTS

KR 1020020081 490 A 10/2002

OTHER PUBLICATIONS

"Analysis of Radiation Characteristics of Planar Inverted-F Type Antenna On Conductive Body of Hand-Held Transceiver By Spatial Network Method", Electronics Letters, Aug. 3, 1989, vol. 25, No. 16, pp. 1044-1045.

*Primary Examiner*—Trinh Vo Dinh
(74) *Attorney, Agent, or Firm*—Blakely, Sokoloff, Taylor & Zafman LLP

(57) ABSTRACT

Provided are a Planar Inverted-F Antenna (PIFA), a Radio Frequency Identification (RFID) tag using the PIFA. The present invention miniaturizes the antenna by using a meander line extended from a radiating edge of a radiation antenna and adjusting a resonant frequency of the antenna, and it performs impedance matching by adjusting capacitive reactance of the antenna. Also, it can perform impedance matching by using a stub having a slot formed therein and adjusting inductive reactance and capacitive reactance of the antenna. The present invention miniaturizes the antenna by using a plurality of shorting plates for shorting the radiation patch from a grounding surface and adjusting the resonant frequency of the antenna. The present invention also provides an inexpensive PIFA antenna with an excellent radiation efficiency by forming the radiation patch in the form of metal sheet in the antenna and floating the radiation patch in the air.

27 Claims, 5 Drawing Sheets

U.S. PATENT DOCUMENTS

| | | | | |
|---|---|---|---|---|
| 7,183,976 | B2 * | 2/2007 | Wu et al. | 343/700 MS |
| 2002/0032510 | A1 * | 3/2002 | Turnbull et al. | 701/49 |
| 2004/0075610 | A1 | 4/2004 | Pan | |
| 2007/0035462 | A1 * | 2/2007 | Hertel | 343/795 |
| 2007/0115177 | A1 * | 5/2007 | Kawahata et al. | 343/700 MS |

* cited by examiner

PIFA, RFID TAG USING THE SAME AND ANTENNA IMPEDANCE ADJUSTING METHOD THEREOF

FIELD OF THE INVENTION

The present invention relates to a Planar Inverted-F Antenna (PIFA), a Radio Frequency Identification (RFID) tag using the PIFA, and an antenna impedance adjusting method thereof; and, more particularly, to a PIFA having a meander line and a reactance controlling stub, an RFID tag using the PIFA, and an antenna impedance adjusting method thereof.

DESCRIPTION OF RELATED ART

Differently from an active RFID reader, a tag is attached to an object of diverse materials and shapes. Minimizing the degradation of antenna characteristics due to the material used for the attachment is the conceptional purpose of tag antenna design. In particular, when a tag antenna is attached to metal, the return loss characteristics and radiation pattern characteristics of the tag antenna can be affected seriously. Therefore, designing an antenna requires much attention. When an ordinary dipole antenna is brought close to a metallic object, the radiation of electromagnetic waves is interrupted by an electromagnetic image effect. Thus, an antenna using the metallic object as part of its radiation structure should be considered as a tag antenna with a metallic object attached thereto. An antenna representing this type of antennas is a microstrip patch antenna and a Planar Inverted-F Antenna (PIFA).

Generally, a microstrip patch antenna has advantages that it can be fabricated easily, light and thin. However, since it has a size of a half wavelength in a resonant frequency, it is a bit too large to be used as a Radio Frequency Identification (RFID) tag antenna. On the other hand, the PIFA has an antenna structure that can reduce the size by a half by shorting a part without an electric field with a conductive plate and be matched to a particular impedance by changing the locations of feed points based on the shorting plate. The PIFA has a size of a fourth wavelength in the resonant frequency. Therefore, the PIFA can be attached to a small metallic object.

FIG. 1 is a perspective view showing a typical PIFA antenna and it is presented in a paper entitled "Analysis of Radiation Characteristics of Planar Inverted-F Type Antenna on Conductive Body of Hand-held Transceiver by Spiral Network Method," by T. Kashiwa, N. Yoshida and I. Fukai, in *IEE Electronics Letters* 3$^{rd}$, Vol. 25, No. 16, August 1989, pp. 1,044-1,045. As shown in the drawing, a typical PIFA is formed of a ground surface 1, a radiation patch 2, a feeder 3, and a shorting plate 4. The shorting plate 4 reduces the size of the PIFA by a half by shorting the radiation patch 2 from the ground surface 1 so that the PIFA becomes a half as large as the microstrip patch antenna. The shorting plate 4 supplies power to the feeder 3 at a point when an antenna impedance is 50Ω by using a co-axial wire. Current generated between the radiation patch and the ground surface is radiated in a field of the PIFA. This is the same as the radiation mechanism of the microstrip patch antenna.

However, since the PIFA suggested in the paper by Kashiwa et al. cannot adjust the antenna impedance at a feeding point, there is a problem that the location of the feeding point should be changed when the feeding point where the impedance becomes 50Ω according to a change in an environment, for example, when the size of the metallic object is changed. Also, since the PIFA suggested in the paper by Kashiwa et al. has a size of a fourth wavelength in the resonant frequency, there is another problem that the size of the antenna is a bit large. Moreover, the PIFA suggested in the paper by Kashiwa et al. cannot support the RFID service sufficiently.

Many researches are carried out to realize multiband, broadband, and miniaturized antennas by adopting a slot and a stub into the typical PIFA. An example of the research activity is U.S. Pat. No. 6,741,214, entitled "Planar Inverted-F Antenna (PIFA) Having a Slotted Radiating Element Providing Global Cellular and GPS-Bluetooth Frequency Response." FIG. 2 shows a perspective view of a PIFA disclosed in the U.S. Pat. No. 6,741,214.

The conventional PIFA illustrated in FIG. 2 includes a C-shaped slot in a radiation patch 16 to realize a dual resonance mode and includes an impedance controlling stub 13 set up perpendicularly to the radiation patch 16 to control capacitive reactance between the radiation patch 16 and the ground plate 11. Metallic objects 12, 13, 14 and 16 are formed of sheet metal and the sheet metal is plated with a dielectric substance 17 to maintain physical stability.

The PIFA suggested in the U.S. Pat. No. 6,741,214, however, can hardly control inductive reactance and capacitive reactance in diverse levels with the impedance controlling stub. Thus, the feeding point for the impedance of 50Ω can be changed according to usage environment. Also, the PIFA of the cited patent has a limitation in miniaturization and it has a problem that the dielectric substance which is used for mechanical stability reduces the bandwidth and radiation efficiency of the antenna.

SUMMARY OF THE INVENTION

It is, therefore, an object of the present invention to miniaturize an antenna by using a meander line extended from a radiating edge of a radiation patch during antenna designing and adjusting a resonant frequency of the antenna, and make it easy to perform impedance matching in the antenna by adjusting capacitive reactance of the antenna.

It is another object of the present invention to make it easy to perform impedance matching in an antenna by using a stub extended from a non-radiating edge of a radiation patch during antenna designing and having a slot formed therein and adjusting inductive reactance and capacitive reactance of the antenna.

It is another object of the present invention to provide a Planar Inverted-F Antenna (PIFA) which is inexpensive and has an excellent radiation efficiency by fabricating the radiation patch in the form of sheet metal and floating the radiation patch in air.

In accordance with an aspect of the present invention, there is provided a PIFA, which includes: a radiation patch having a radiating edge and a non-radiating edge; a grounding surface; at least one shorting plate for shorting the radiation patch from the grounding surface; a feeder for providing radio frequency (RF) power to the radiation patch; and a meander line extended from the radiating edge toward the grounding surface and positioned with a predetermined distance from the grounding surface.

In accordance with another aspect of the present invention, there is provided a PIFA, which includes: a radiation patch having a radiating edge and a non-radiating edge; a grounding surface; at least one shorting plate for shorting the radiation patch from the grounding surface; a feeder for providing RF power to the radiation patch; and a stub extended from the non-radiating edge and controlling reactance of the antenna.

The stub includes a stub connector formed of a plurality of metal plates extended from the non-radiating edge toward the grounding surface; a stub body connected to the stub connector and positioned with a predetermined distance from the grounding surface; and a slot formed in the stub body.

The present invention also provides a radio frequency identification (RFID) tag including the PIFA. Further, the present invention provides diverse impedance adjusting methods using the PIFA.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1:
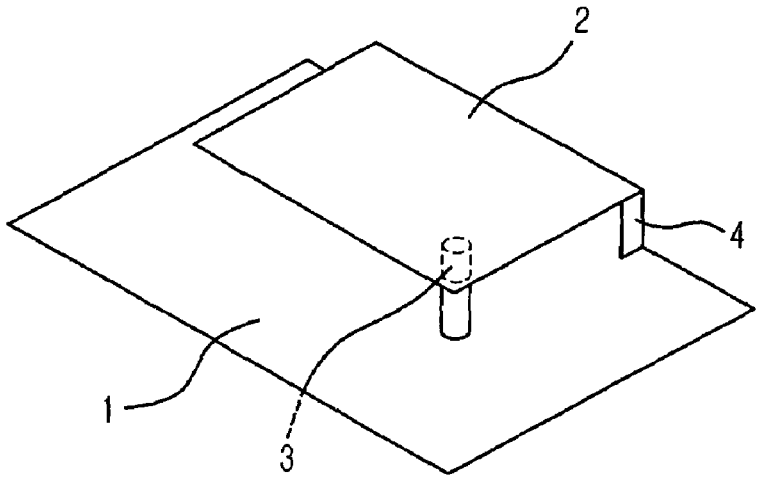
FIG. 1 (PRIOR ART)
FIG. 1 is a perspective view showing a typical Planar Inverted-F Antenna (PIFA)
Figure 2:
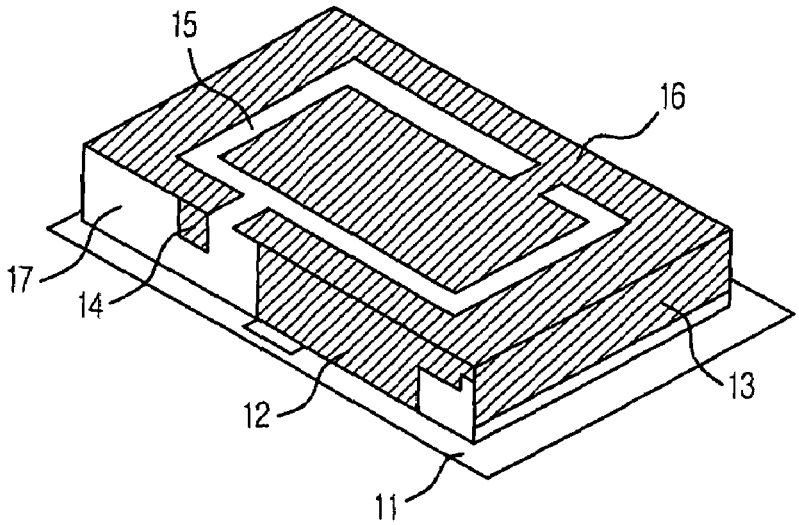
FIG. 2 (PRIOR ART)
FIG. 2 is a perspective view showing a typical PIFA.
Figure 3:
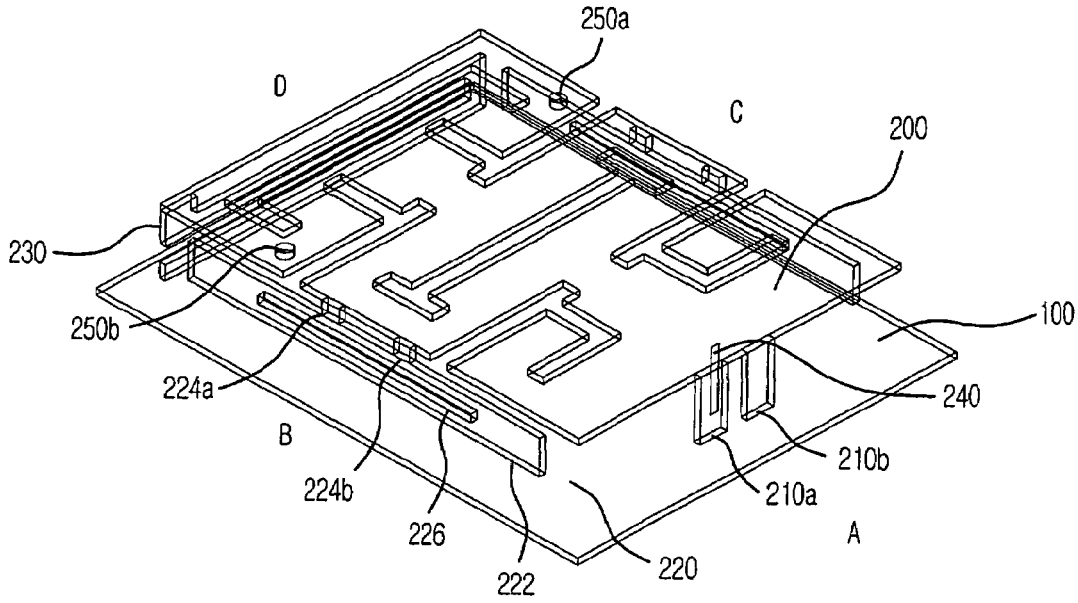
FIG. 3 is a perspective view describing a PIFA in accordance with an embodiment of the present invention.

FIG. 3 is a perspective view describing a Planar Inverted-F Antenna (PIFA) in accordance with an embodiment of the present invention. The PIFA includes a ground surface 100 in the lower part and a radiation patch 200 with a predetermined space from the ground surface 100. The radiation patch 200 is short from the ground surface 100 by shorting plates 210*a* and 210*b*. The radiation patch 200 has a radiating edge where radiation occurs mainly and a non-radiating edge. In FIG. 3, the regions A, B and C of the shorting plates 210*a* and 210*b* correspond to the non-radiating edge, whereas the region D in opposite to the shorting plates 210*a* and 210*b* corresponds to the radiating edge.

In the non-radiating edges B and C of the antenna, reactance controlling stubs 250 are extended from the radiation patch 200 in the downward vertical direction, i.e., toward the ground surface 100. The reactance controlling stubs 250 adjusts capacitive reactance and inductive reactance of the antenna. In the radiating edge D of the antenna, a meander line 230 is extended from the radiation patch 200 downward. The meander line 230 contributes to the miniaturization of the antenna by adjusting the resonant frequency of the antenna. Also, the meander line 230 can control the capacitive reactance of the antenna. A slot formed in the radiation patch 200 affects the resonant frequency of the antenna and contributes to the miniaturization of the antenna.

A feeder 240 is connected to the radiation patch 200 by using a co-axial cable and provides radio frequency (RF) power to a point where the antenna impedance is 50Ω. Supporting rods 250*a* and 250*b* is formed of a non-metallic material and they secure mechanical stability of the antenna. The PIFA has a structure where the radiation patch 200 floats in the air to raise the radiation efficiency. In other words, the space between the radiation patch 200 and the ground surface 100 is filled with the air. In this case, the mechanical stability of the antenna can be a problem.

To solve the problem, the supporting rods 250*a* and 250*b* are positioned between the radiation patch 200 and the ground surface 100 to thereby connect the radiation patch 200 and the ground surface 100. The supporting rods 250*a* and 250*b* are formed of a non-metallic material so as not to affect the electromagnetic waves radiated from the antenna, and it is preferred to position the supporting rods 250*a* and 250*b* in an area of weak current distribution in the antenna. With the two supporting rods 250*a* and 250*b* and the two shorting plates 250*a* and 250*b*, the PIFA of the present invention secure mechanical stability.

Figure 4A:
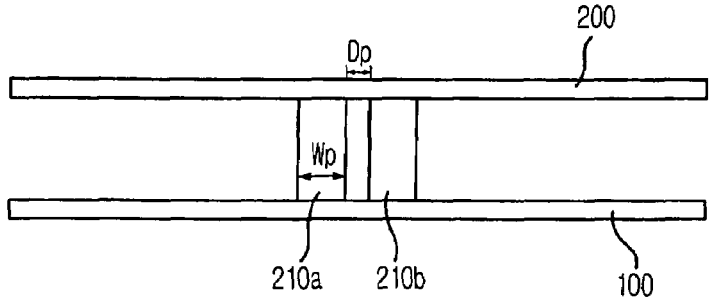
FIG. 4A is a cross-sectional view illustrating an A part of FIG. 3 in detail.

The PIFA shown in FIG. 3 will be described more in detail with reference to FIGS. 4A, 4B, 4C and 4D. FIG. 4A shows the A part of FIG. 3. The shorting plates 210*a* and 210*b* short the radiation patch 200 from the ground plate 100 physically to thereby form an antenna impedance of 50Ω around the shorting plates 210*a* and 210*b*. The two shorting plates 210*a* and 210*b* are positioned with a predetermined distance (Dp) between them.

The point where the antenna impedance becomes 50Ω can be changed into diverse positions by varying the distance (Dp) between the shorting plates 210*a* and 210*b*. Also, since the variation in the distance (Dp) between the shorting plates 210*a* and 210*b* leads to a change in the capacitive reactance between the shorting plates 210*a* and 210*b*, the shorting plates 210*a* and 210*b* can be used for impedance matching in the antenna. The longer the distance (Dp) between the shorting plates 210*a* and 210*b* becomes, the higher the capacitive reactance between the shorting plates 210*a* and 210*b* is. On the contrary, when the distance (Dp) between the shorting plates 210*a* and 210*b* is decreased, the capacitive reactance between the shorting plates 210*a* and 210*b* is reduced.

Meanwhile, the resonant frequency of the antenna is changed based on the width (Wp) of the shorting plates 210*a* and 210*b*. When the width (Wp) of the shorting plates 210*a* and 210*b* is increased, the resonant frequency is raised. When the width (Wp) is decreased, the resonant frequency falls down. Therefore, when the widths of the two shorting plates are set up differently, the resonant frequency of the antenna can be changed diversely. It is obvious to those skilled in the art that the shorting plates can be formed more than three of them.

Figure 4B:
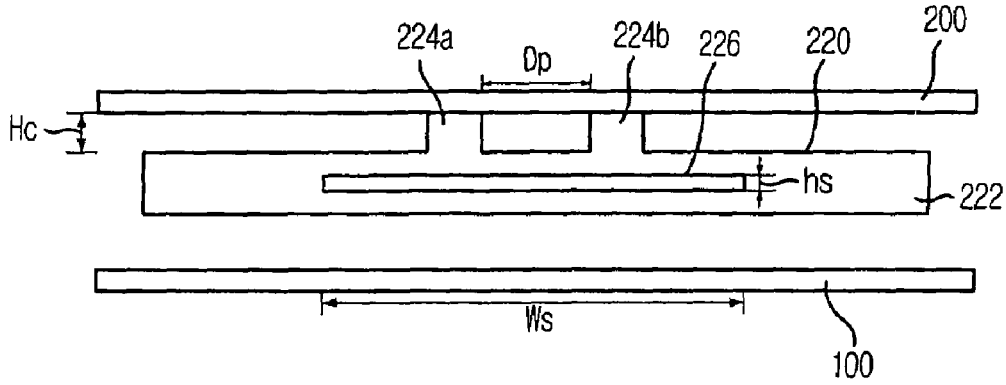
FIG. 4B is a cross-sectional view depicting B and C parts of FIG. 3 in detail.

FIG. 4B shows B and C parts of FIG. 3. A reactance controlling stud 220 is extended from the radiation patch 200 in the downward vertical direction, that is, toward the ground surface 100. Since the reactance controlling stub 220 is positioned in the non-radiating edge of the antenna, it does not give a great influence on the radiation pattern of the antenna. The reactance controlling stub 220 is formed of a stub body 222 and stub connectors 224*a* and 224*b*. The stub connectors 224*a* and 224*b* are two metal plates extended from the non-radiating edges of the radiation patch 200 in the downward vertical direction to be connected to the stub body 222. The stub body 222 has a slot 226 formed therein.

The capacitive reactance between the two stub connectors 224*a* and 224*b* can be adjusted by adjusting a distance (Dc) between the stub connectors 224*a* and 224*b*. When the distance (Dc) between the stub connectors 224*a* and 224*b* is increased, the capacitive reactance between the two stub connectors 224*a* and 224*b* is raised. On the contrary, when the distance (Dc) between the stub connectors 224*a* and 224*b* is decreased, the capacitive reactance between the two stub connectors 224*a* and 224*b* is reduced.

Also, the capacitive reactance between the stub body 222 and the ground surface 100 can be adjusted by adjusting a length (Hc) of the stub connectors 224*a* and 224*b*. A change in the length (Hc) of the stub connectors 224*a* and 224*b* changes the distance between the stub body 222 and the ground surface 100, which eventually leads to a change in the capacitive reactance between the stub body 222 and the ground surface 100. When the length (Hc) of the stub connectors 224*a* and 224*b* is raised, the capacitive reactance between the stub body 222 and the ground surface 100 is decreased. On the contrary, when the length (Hc) of the stub connectors 224*a* and 224*b* is reduced, the capacitive reactance between the stub body 222 and the ground surface 100 is increased. In short, it is possible to realize diverse levels of capacitive reactance between the stub body 222 and the ground surface 100 according to the length (Hc) of the stub connectors 224*a* and 224*b*.

Meanwhile, the inductive reactance can be changed by forming the slot 226 in the stub body 222 and rotating the current flowing through the stub body 222. Diverse levels of inductive reactance can be acquired by adjusting the width (Ws) and length (Hs) of the slot 226. To put it another way, the current flowing through the stub body 22 by the slot 226 has a characteristic of rotation, and the rotation quantity is determined based on the width (Ws) and length (Hs) of the slot 226. Therefore, diverse levels of inductive reactance can be obtained. When the width (Ws) and length (Hs) of the slot 226 is raised, the inductive reactance is increased. On the contrary, when the width (Ws) and length (Hs) of the slot 226 is reduced, the inductive reactance is decreased.

Figure 4C:
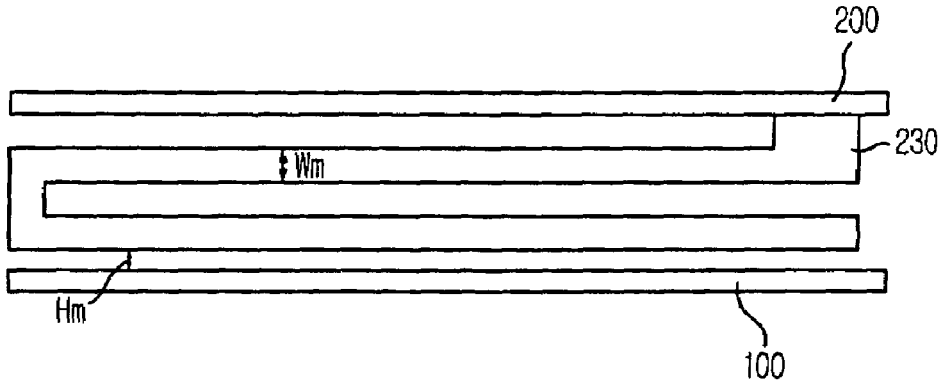
FIG. 4C is a cross-sectional view illustrating a D part of FIG. 3 in detail.

FIG. 4C shows the D part of FIG. 3. The meander line 230 is extended from the radiation patch 200 in the downward vertical direction and it is positioned with a predetermined distance (Hm) from the ground surface 100. The meander line 230 extends the resonance length of the radiation patch 230. That is, since excited current in the feeder 240 flows to the end of the radiation patch 200 until it reaches the meander line 230, there is an effect that the resonance length of the antenna is lengthened as much as length of the meander line. Therefore, the antenna can be miniaturized.

The entire length of the meander line 230 can be adjusted by adjusting the width (Wm) of the meander line 230, and diverse resonant frequencies can be acquired through the adjustment of the length. For example, when the width (Wm) of the meander line 230 is reduced, the entire length of the meander line 230 is increased to thereby reduce the resonant frequency. Therefore, it is possible to realize a small antenna resonating in a predetermined frequency.

Also, it is possible to adjust the capacitive reactance formed between the meander line 230 and the ground surface 100 by controlling the distance (Hm) between the lower part of the meander line 230 and the ground surface 100.

Figure 4D:
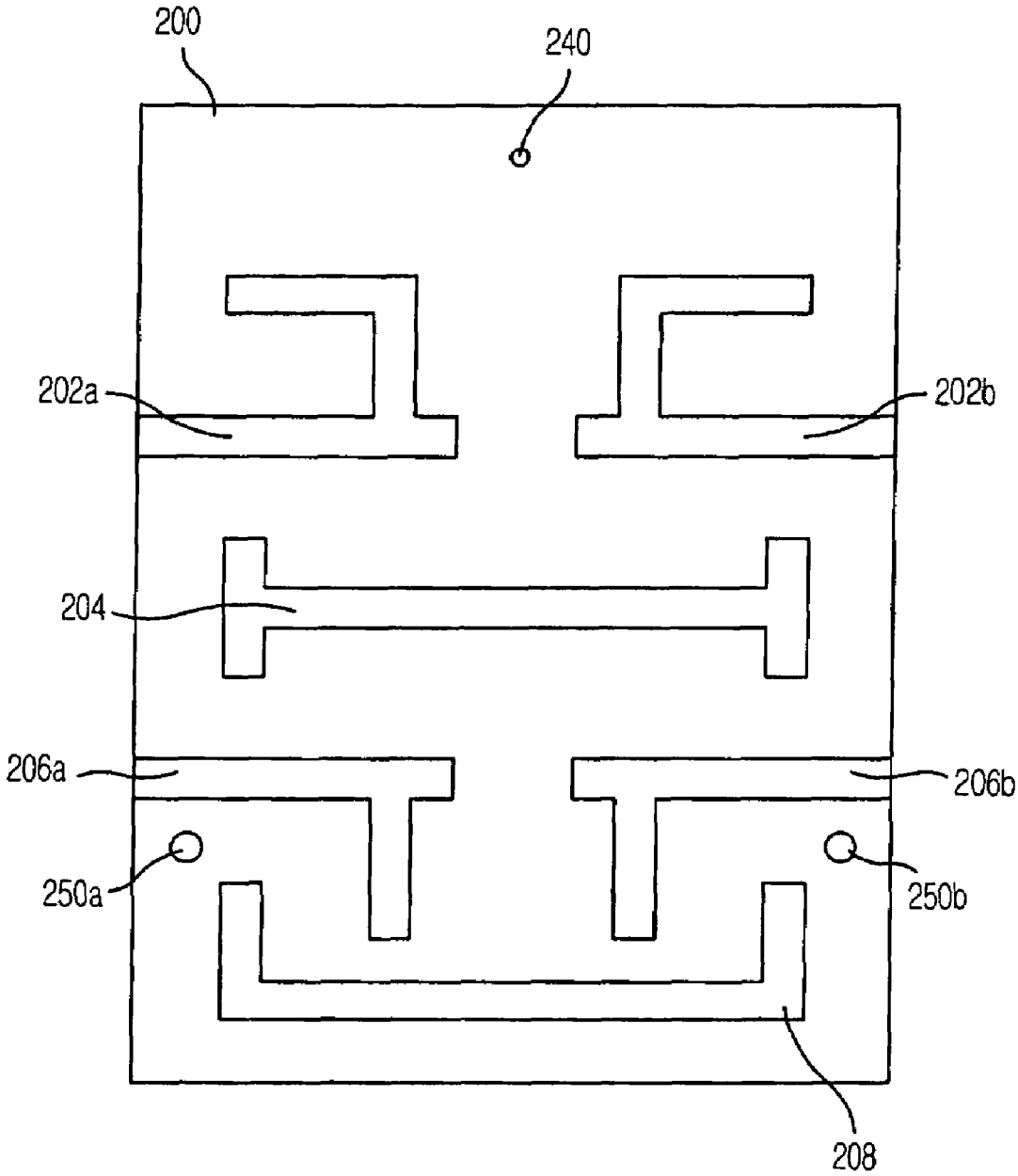
FIG. 4D is a plane view showing a radiation patch of FIG. 3.

FIG. 4D shows the radiation patch 200 of FIG. 3. The radiation patch 200 includes T-shaped slots 202*a*, 202*b*, 206*a* and 206*b*, an I-shaped slot 204, and a c-shaped slot 208 formed therein. The slots of the radiation patch 200 lengthen the resonance length of current flowing through the PIFA to thereby reduce the resonant frequency, thus contributing to the miniaturization of the antenna. In FIG. 4D, the slots are formed symmetrically but they need not be symmetrical necessarily. Also, it is apparent to those skilled in the art that the diverse shapes of slots other than the presented T-shaped, I-shaped and c-shaped ones can be formed to reduce the resonant frequency of the antenna.

Figure 5:
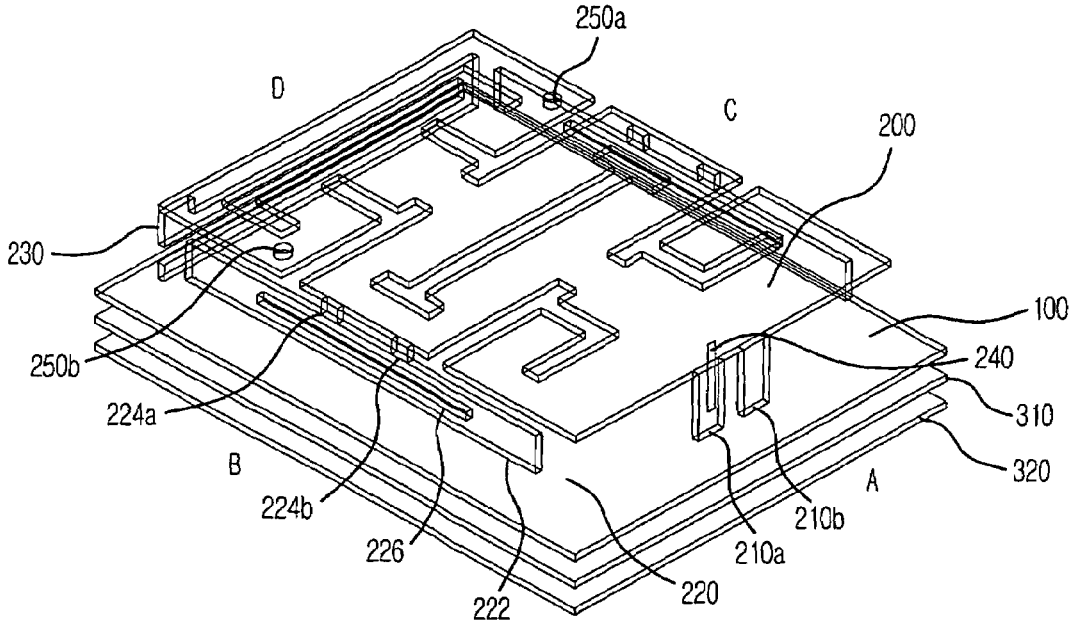
FIG. 5 is a perspective view describing a Radio Frequency Identification (RFID) tag in accordance with an embodiment of the present invention.

FIG. 5 shows an RFID tag to which the PIFA of the present invention is applied. The RFID tag is formed of the PIFA, an RF transceiving board 310, and a digital processing board 320. Since the RF transceiving board 310 and the digital processing board 320 are the same as those used for conventional active RFID tags, further description on them will not be provided herein.

The RF transceiving board 310 demodulates RF signals received through the PIFA into baseband signals, converts them into digital signals, and transmits the digital signals to the digital processing board 320, and the RF transceiving board 310 modulates the signals transmitted from the digital processing board 320 into the RF signals and transmits the RF signals to an RFID reader (not shown) through the PIFA.

The digital processing board 320 analyzes the digital signals inputted from the RF transceiving board 310, such as wake-up signals and command signals, and executes commands of the digital signals. It also generates digital signals to transmit information of the RFID tag to the RFID reader and transmits the generated digital signals to the RF transceiving board 310.

The RF transceiving board 310 and the feeder 210 of the PIFA are connected through a co-axial cable. To be specific, the external conductor of the co-axial cable is connected to the ground surface 200 and the internal conductor is connected to the feeder 210.

As described above, the technology of the present invention can miniaturize an antenna by extending the resonance length of the antenna with diverse forms of slots formed in the radiation patch. Also, it makes it easy to perform impedance matching in the antenna by positioning diverse forms of stubs in a non-radiating edge.

The technology of the present invention also makes the resonant frequency of the antennal variable by changing the width and distance between the shorting plates while performing impedance matching easily in the antenna. It contributes to the miniaturization of the antenna based on the varying resonant frequency while performing impedance matching easily in the antenna.

The present application contains subject matter related to Korean patent application Nos. 2004-0103087 and 2005-0049266, filed in the Korean Intellectual Property Office on Dec. 8, 2004, and Jun. 9, 2005, respectively, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A Planar Inverted-F Antenna (PIFA), comprising:

a radiation patch having a radiating edge and a non-radiating edge;

a grounding surface;

at least one shorting plate for shorting the radiation patch from the grounding surface;

a feeder for providing radio frequency (RE) power to the radiation patch;

a meander line extended from the radiating edge toward the grounding surface and positioned with a predetermined distance from the grounding surface; and a stub extended from the non-radiating edge wherein the stub includes:

a stub connector formed of a plurality of metal plates extended from the non-radiating edge toward the grounding surface;

a stub body connected to the stub connector and positioned with a predetermined distance from the grounding surface; and a slot formed in the stub body.

2. The PIFA as recited in claim 1, wherein a resonant frequency of the PIFA is adjusted according to width of the meander line.

3. The PIFA as recited in claim 1, wherein capacitive reactance of the PIFA is adjusted according to the distance between a lower part of the meander line and the grounding surface.

4. The PIFA as recited in claim 1, wherein the capacitive reactance of the antenna is adjusted based on a distance between the metal plates of the stub connector.

5. The PIFA as recited in claim 1, wherein the capacitive reactance of the antenna is adjusted based on a length of the stub connector.

6. The PIFA as recited in claim 1, wherein inductive reactance of the antenna is adjusted based on width or length of the slot.

7. The PIFA as recited in claim 1, further comprising: a plurality of shorting plates.

8. The PIFA as recited in claim 7, wherein impedance of the antenna is adjusted based on a distance between the shorting plates.

9. The PIFA as recited in claim 7, wherein the resonant frequency of the antenna is adjusted based on width between the shorting plates.

10. The PIFA as recited in claim 7, wherein each of the shorting plates has a different width.

11. The PIFA as recited in claim 1, wherein diverse slots are formed in the radiation patch.

12. The PIFA as recited in claim 11, wherein the slots include an I-shaped slot, a T-shaped slot, and a C-shaped slot.

13. The PIFA as recited in claim 1, further comprising: supporting rods formed of a non-metallic material for connecting the radiation patch to the grounding surface.

14. A Planar Inverted-F Antenna (PIFA), comprising:

a radiation patch having a radiating edge and a non-radiating edge;

a grounding surface;

at least one shorting plate for shorting the radiation patch from the grounding surface;

a feeder for providing radio frequency (RF) power to the radiation patch; and a stub extended from the non-radiating edge and controlling reactance of the antenna wherein the stub includes:

a stub connector formed of a plurality of metal plates extended from the non-radiating edge toward the grounding surface;

a stub body connected to the stub connector and positioned with a predetermined distance from the grounding surface; and a slot formed in the stub body.

15. The PIFA as recited in claim 14, wherein capacitive reactance of the antenna is adjusted based on a distance between the metal plates of the stub connector or a length of the stub connector.

16. The PIFA as recited in claim 14, wherein inductive reactance of the antenna is adjusted based on width or length of the slot.

17. The PIFA as recited in claim 14, further comprising:

a plurality of shorting plates.

18. The PIFA as recited in claim 17, wherein impedance of the antenna is adjusted based on a distance between the shorting plates, and a resonant frequency of the antenna is adjusted based on width of the shorting plates.

19. The PIFA as recited in claim 17, wherein each of the shorting plates has a different width.

20. The PIFA as recited in claim 14, wherein diverse slots are formed in the radiation patch.

21. The PIFA as recited in claim 14, further comprising: supporting rods formed of a non-metallic material for connecting the radiation patch to the grounding surface.

22. A Radio Frequency Identification (RFID) tag, comprising:

a Planar Inverted-F Antenna (PIFA);

a digital processor for generating a digital signal on information for the RFID tag; and an RF transceiver for modulating the digital signal into an RF signal and transmitting the RF signal through the PIFA, wherein the PIFA includes:

a radiation patch having a radiating edge and a non-radiating edge;

a grounding surface;

at least one shorting plate for shorting the radiation patch from the grounding surface;

a feeder for providing RF power to the radiation patch;

a meander line extended from the radiating edge toward the grounding surface and positioned with a predetermined distance from the grounding surface; and a stub extended from the non-radiating edge wherein the stub includes:

a stub connector formed of a plurality of metal plates extended from the non-radiating edge toward the grounding surface;

a stub body connected to the stub connector and positioned with a predetermined distance from the grounding surface; and a slot formed in the stub body.

23. A Radio Frequency Identification (RFID) tag, comprising:

a Planar Inverted-F Antenna (PIFA);

a digital processor for generating a digital signal on information for the RFID tag; and an RF transceiver for modulating the digital signal into an RF signal and transmitting the RF signal through the PIFA, wherein the PIFA includes:

a radiation patch having a radiating edge and a non-radiating edge;

a grounding surface;

at least one shorting plate for shorting the radiation patch from the grounding surface;

a feeder for providing RF power to the radiation patch;

a stub connector formed of a plurality of metal plates extended from the non-radiating edge toward the grounding surface;

a stub body connected to the stub connector and positioned with a predetermined distance from the grounding surface; and a slot formed in the stub body.

24. A method for adjusting impedance of a Planar Inverted-F Antenna (PIFA), comprising the step of:

a) adjusting capacitive reactance of the PIFA according to a distance between a lower part of a meander line and a grounding surface, wherein the PIFA includes:

a radiation patch having a radiating edge and a non-radiating edge;

the grounding surface;

at least one shorting plate for shorting the radiation patch from the grounding surface;

a feeder for providing radio frequency (RF) power to the radiation patch;

the meander line extended from the radiating edge toward the grounding surface and positioned with a predetermined distance from the grounding surface; and a stub extended from the non-radiating edge and including:

a stub connector formed of a plurality of metal plates extended from the non-radiating edge toward the grounding surface;

a stub body connected to the stub connector and positioned with a predetermined distance from the grounding surface; and a slot formed in the stub body.

25. The method as recited in claim 24, wherein the capacitive reactance of the antenna is adjusted based on a distance between the metal plates of the stub connector or a length of the stub connector.

26. The method as recited in claim 25, wherein a inductive reactance of the antenna is adjusted based on width or length of the slot.

27. The method as recited in claim 26, wherein impedance of the antenna is adjusted based on a distance between the shorting plates.

* * * * *